US005592762A

United States Patent [19]

Hendron et al.

[11] Patent Number: 5,592,762

[45] Date of Patent: Jan. 14, 1997

[54] EXCAVATOR BUCKET LINKAGE

[75] Inventors: Scott S. Hendron; Michael E. Kennedy, both of Dubuque, Iowa

[73] Assignee: Deere & Company, Moline, Ill.

[21] Appl. No.: 515,851

[22] Filed: Aug. 16, 1995

[51] Int. Cl.[6] ..... E02F 3/32

[52] U.S. Cl. ..... 37/443; 37/444; 37/403; 414/694; 414/707

[58] Field of Search ..... 37/443, 444, 411, 37/403; 414/685, 694, 695.5, 723, 707, 713, 700

[56] References Cited

U.S. PATENT DOCUMENTS

| | | | |
|---|---|---|---|
| 2,590,454 | 3/1952 | Pilch | 414/713 X |
| 2,753,059 | 7/1956 | Pilch | 414/713 |
| 3,042,233 | 7/1966 | Wills | 414/694 |
| 3,243,065 | 3/1966 | Moore | 414/694 |
| 3,243,067 | 3/1966 | Artman | 414/713 X |
| 3,510,017 | 5/1970 | Guinot | 37/403 X |
| 3,536,215 | 10/1970 | Waite | 414/694 |
| 3,550,795 | 12/1970 | Schofield | 414/694 |
| 4,239,444 | 12/1980 | Schmelzer | 414/697 X |
| 4,277,899 | 7/1981 | Güthoff | 37/443 |
| 4,364,705 | 12/1982 | Shumaker | 414/713 |
| 4,381,167 | 4/1983 | Baty | 414/697 |
| 4,403,429 | 9/1983 | Haringer | 37/443 |
| 4,480,942 | 11/1984 | Farrow | 414/694 X |
| 4,639,183 | 1/1987 | Güthoff | 37/443 X |
| 4,768,917 | 9/1988 | Garman | 414/713 X |
| 5,051,057 | 9/1991 | Kremer | 414/685 |
| 5,176,491 | 1/1993 | Houkom | 414/694 |
| 5,188,502 | 2/1993 | Tonsor et al. | 414/700 |

FOREIGN PATENT DOCUMENTS

| | | | |
|---|---|---|---|
| 1258980 | 3/1961 | France | 37/443 |

OTHER PUBLICATIONS

Three photos of Lokomo excavator including brief description of excavator's benefits. (No Date Shown).

Caterpillar Integrated Tool Carrier Linkage, Jan. 1993.

JCB Backhoe Loader Parts Book, Publication No. 9800/8552, cover page. (Date Unknown).

John Deere Extendable Dipperstick Advertisement (Date Unknown).

Caterpillar 416B Advertisement (Date Unknown).

Liebherr Advertisement Picture (Date Unknown).

*Primary Examiner*—Terry Lee Melius
*Assistant Examiner*—Thomas A. Beach

[57] ABSTRACT

An excavator linkage comprising a ternary link with first, second and third pivot connections and a follower link with first and second pivot connections. The first pivot connection of the ternary link is pivotally coupled to the rod end of the bucket actuating hydraulic cylinder. The second pivot connection of the ternary link is pivotally coupled to the excavator bucket. In addition, the excavator bucket is pivotally connected to the dipperstick. The follower link has a first pivot connection that is pivotally connected to the dipperstick and a second pivot connection that is pivotally connected to the third pivot connection of the ternary link. In one frame of reference, the third pivot connection of the ternary link is located between the first and second pivot connections of the ternary link. In addition, the third pivot connection of the ternary link lies above a plane defined by the first and second pivot connections of the ternary link. In another frame of reference the second and third pivot connections of the ternary link define a plane below which the first pivot connection is located. Furthermore, the first pivot connection lies above a second plane which is perpendicular to the first plane and intersects the first plane at the third pivot connection.

6 Claims, 2 Drawing Sheets

EXCAVATOR BUCKET LINKAGE

BACKGROUND OF THE INVENTION

1. Field of the Invention

The invention is directed to an improved excavator bucket linkage allowing adequate rollback for vertical wall digging and improved bucket curl for truck loading.

2. Description of the Prior Art

Excavators such as backhoes, are work vehicles used for a variety of jobs. An excavator is provided with a pivotal boom to which is attached a pivotal dipperstick. The positions of the boom relative to the vehicle and the dipperstick relative to the boom are controlled by hydraulic cylinders. Typically, a bucket is pivotally attached to the end of the dipperstick remote from the boom. A hydraulic cylinder pivotally attached to the dipperstick is used to position the bucket relative to the dipperstick through a bucket linkage.

A typical bucket linkage is illustrated in US Pat. No. 5,051,057. A binary link extends between the bucket hydraulic cylinder and the bucket. The binary link has a first pivot connection pivotally coupling the binary link to the rod end of the bucket hydraulic cylinder and a second pivot connection pivotally coupling the binary link to the bucket. A follower link extends from the dipperstick to the first pivot connection of the binary link.

Because of interference considerations, forces and velocities at extremes of travel, the bucket is provided with two holes to which the binary link can be pivotally coupled. The first hole allows sufficient rollback to vertical wall digging, and the second hole gives improved truck loading (extreme curled position). In selecting a mode of operation, the operator couples the binary link to one of the two holes.

Another bucket linkage is disclosed in US Pat. No. 4,381,167. This linkage uses four links to improve cutting force at the extreme rollback and extreme curled positions.

SUMMARY

It is an object of the present invention to provide a bucket linkage which has superior operating characteristics at the extreme roll back and curled positions.

The bucket linkage of the present invention comprises a ternary link having a first, second and third pivot connections. The first pivot connection of the ternary link is coupled to the rod end of the bucket actuating hydraulic cylinder. The second pivot connection of the ternary link is pivotally coupled to the bucket. The bucket in turn is pivotally coupled to an excavator dipperstick, and the cylinder end of the bucket actuating hydraulic cylinder is also attached thereto. A follower link having first and second pivot connections is positioned between the third pivot connection on the ternary link and the dipperstick.

An important element of the following invention is the relationship of the pivot connections on the ternary link. More specifically, the third pivot connection of the ternary link is positioned between the first and second pivot connections of the ternary link. The first and second pivot connections also define a plane above which the third pivot connection is located away from the dipperstick.

Another way of looking at the geometry of the ternary link is that the second and third pivot connections define a plane. The first pivot connection lies below that plane towards the excavator dipperstick. In addition, a second plane can be defined as being perpendicular to the first plane and intersecting the first plane at the third pivot connection. The first pivot connection would lie above the second plane away from the second pivot connection of the ternary link.

DETAILED DESCRIPTION

Figure 1:
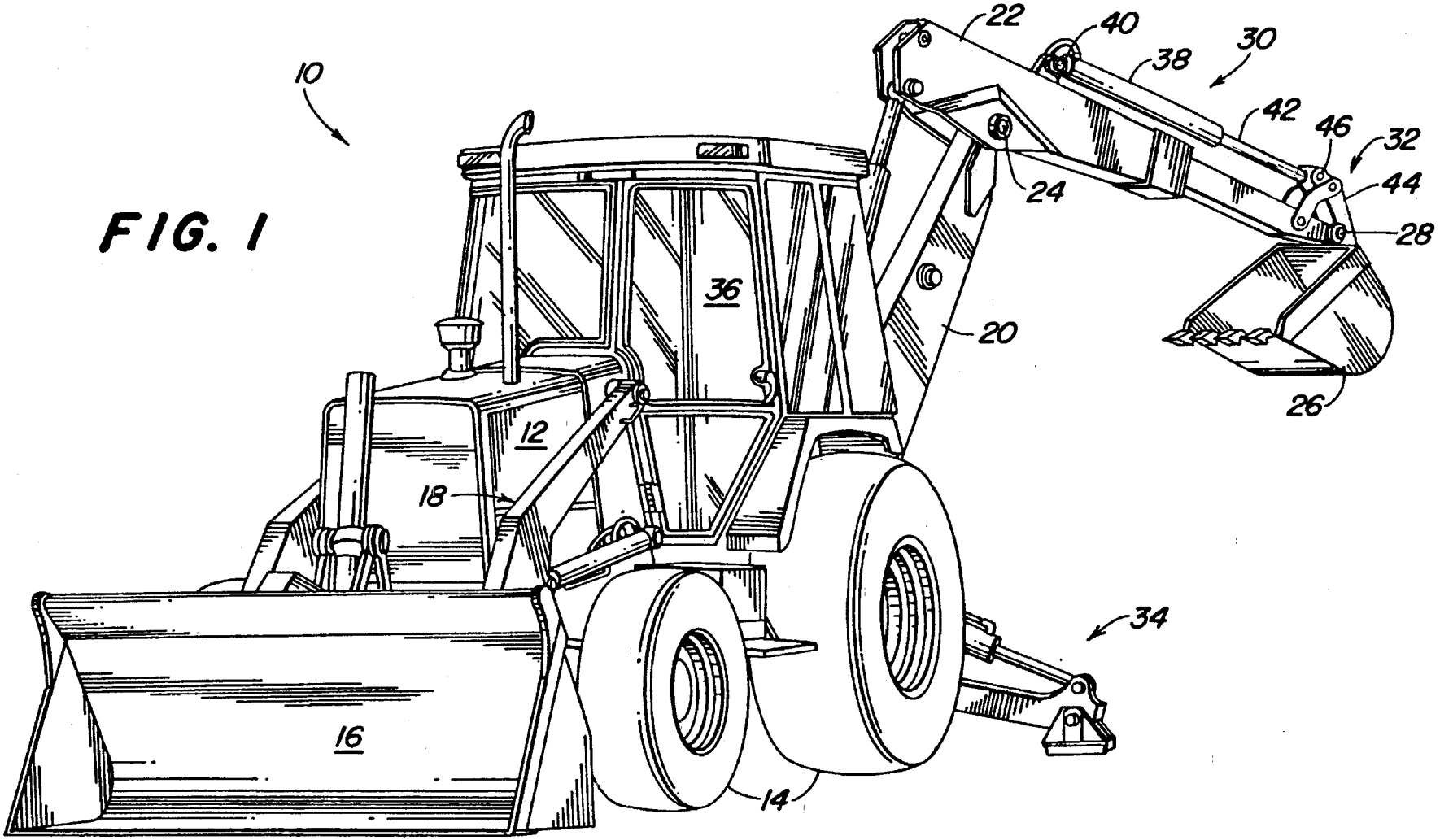
FIG. 1 is a perspective view of a backhoe loader.
Figure 2:
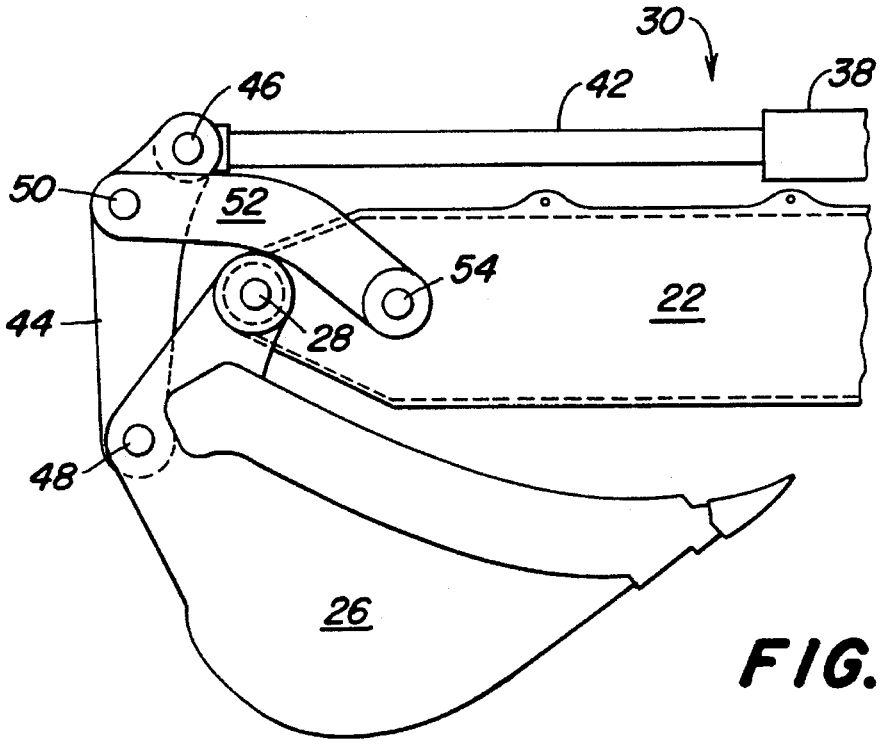
FIG. 2 is a side view of the bucket linkage in an extreme curled position.
Figure 3:
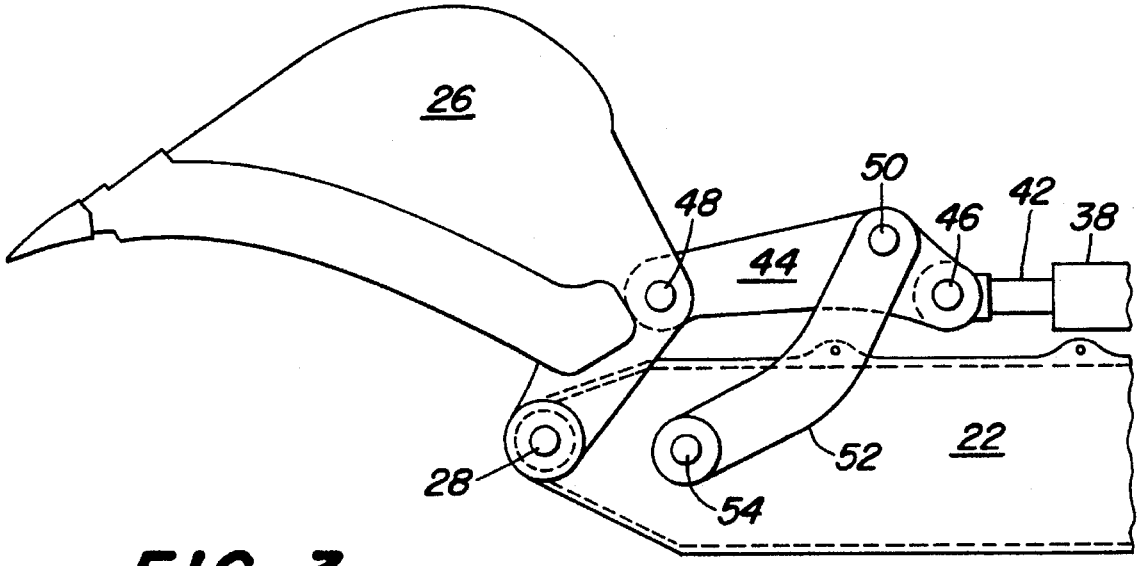
FIG. 3 is a side view of the bucket linkage in an extreme roll back position.

FIG. 1 illustrates a work vehicle, such as a backhoe loader 10, having a frame 12 to which are mounted ground engaging means 14 for supporting and propelling the frame. The backhoe loader is provided with a loader bucket 16 having a suitable loader bucket linkage 18 for manipulating the loader bucket relative to the frame. The rear of the backhoe loader is provided with a backhoe having a boom 20 that is pivotally coupled to the frame, a dipperstick 22 that is pivotally connected to the boom at pivot 24 and a bucket 26 that is pivotally connected to the dipperstick 22 at pivot 28. A bucket actuating hydraulic cylinder 30 manipulates the bucket 26 through a bucket linkage 32. The backhoe loader is also provided with two stabilizers 34, only one shown. The operation of the vehicle is controlled from operator's cab 36.

The dipperstick illustrated in FIG. 1 is an extendible dipperstick, and should not effect the scope of the present invention. Bucket actuator hydraulic cylinder 30 has a cylinder end 38 that is pivotally coupled to the dipperstick at 40. The rod end 42 of the bucket actuator hydraulic cylinder is pivotally connected to a first ternary link 44 at the first pivot connection 46 of the ternary link. The ternary link is provided with a second pivot connection 48 which is pivotally connected to the bucket 26. The ternary link is also provided with a third pivot connection 50 that is pivotally connected to the second pivot connection of a dog leg or bent follower link 52. The follower link in turn has a first pivot connection 54 which is pivotally connected to the excavator dipperstick 22.

The key feature of the present invention is the geometric arrangement of pivot points on the ternary link. More specifically, in one frame of reference the third pivot connection of the ternary link is located between the first and second pivot connections of the ternary link. In addition, the first and second pivot connections of the ternary link may define a plane above which the third pivot connection lies away from the dipperstick.

In another frame of reference, the second and third pivot connections of the ternary link define a plane. The first pivot connection lies below that plane towards the dipperstick. A second plane can be defined as being perpendicular to and intersecting the first plane at the third pivot connection. The first pivot connection would lie above this plane away from the bucket.

The present arrangement of pivot and links produces a flater bucket edge cutting force curve, as the bucket moves from an extreme roll back to an extreme curled position, than is provided by a conventional linkage. Therefore the present invention should not be limited by the above described embodiments but should be limited solely by the claims that follow.

We claim:

1. A bucket linkage for manipulating an excavator bucket that is pivotally attached to an excavator dipperstick, the bucket linkage comprising:

a hydraulic cylinder having a cylinder end that is pivotally coupled to said excavator dipperstick and having an opposite rod end;

a ternary link having a first pivot connection being pivotally coupled to the rod end of the hydraulic cylinder, a second pivot connection being pivotally coupled to said excavator bucket, and a third pivot connection located between the first and second pivot connections, the first and second pivot connections of the ternary link define a plane and the third pivot connection lies above the plane away from said excavator dipperstick; and a follower link having a first pivot connection pivotally coupling the follower link to the excavator dipperstick and a second pivot connection pivotally coupling the follower link to the third pivot connection of the ternary link.

2. A bucket linkage for manipulating an excavator bucket being pivotally attached to an excavator dipperstick, the bucket linkage comprising:

a hydraulic cylinder having a cylinder end that is pivotally coupled to said excavator dipperstick and having an opposite rod end;

a ternary link having a first pivot connection being pivotally coupled to the rod end of the hydraulic cylinder, a second pivot connection being pivotally coupled to said excavator bucket, and a third pivot connection, the second and third pivot connections of the ternary link define a plane and the first pivot connection lies below the plane towards said excavator dipperstick; and a follower link having a first pivot connection pivotally coupling the follower link to the excavator dipperstick and a second pivot connection pivotally coupling the follower link to the third pivot connection of the ternary link.

3. A bucket linkage as defined by claim 2 wherein a second plane perpendicular to the plane defined by the second and third pivot connections of the ternary link intersects the third pivot connection of the ternary link, the FIRST pivot connection of the ternary link is located above the second plane away from the second pivot connection of the ternary link.

4. A work vehicle for performing a work operation, the work vehicle comprising:

a frame;

ground engaging means are coupled to the frame for supporting propelling the frame;

a boom is pivotally coupled to the frame;

a dipperstick is pivotally coupled to the boom;

a hydraulic cylinder having a cylinder end that is pivotally coupled to said excavator dipperstick and having an opposite rod end;

a first link having a first pivot connection being pivotally coupled to the rod end of the hydraulic cylinder, a second pivot connection being pivotally coupled to said excavator bucket, and a third pivot connection located between the first and second pivot connections, the first and sdcond pivot connetions of the first link define a plane and the third pivot connection lies above the plane away from said excavator dipperstick; and a second link having a first pivot connection pivotally coupling the second link to the excavator dipperstick and a second pivot connection pivotally coupling the third pivot connection of the first link.

5. A work vehicle for performing a work operation, the work vehicle comprising:

a frame;

ground engaging means are coupled to the frame for supporting the propelling the frame;

a boom is pivotally coupled to the frame;

a dipperstick is pivotally coupled to the boom;

a hydraulic cylinder having a cylinder end that is pivotally coupled to said excavator dipperstick and having an opposite rod end;

a ternary link having a first pivot connection being pivotally coupled to the rod end of the hydraulic cylinder, a second pivot connection being pivotally coupled to said excavator bucket, and a third pivot connection, the second and third pivot connections of the ternary link define a plane and the first pivot connection lies below the plane towards said excavator dipperstick; and a follower link having a first pivot connection pivotally coupling the follower link to the excavator dipperstick and a second pivot connection pivotally coupling the follower link to the third pivot connection of the ternary link.

6. A work vehicle as defined by claim 5 wherein a second plane perpendicular to the plane defined by the second and third pivot connections of the ternary link intersects the third pivot connection of the ternary link, the FIRST pivot connection of the ternary link is located above the second plane away from the second pivot connection of the ternary link.

* * * * *